United States Patent [19]

Morris

[11] 4,359,113

[45] Nov. 16, 1982

[54] EARTH BORING BIT WITH EXTENDED GAGE

[75] Inventor: Wilford V. Morris, Houston, Tex.

[73] Assignee: Hughes Tool Company, Houston, Tex.

[21] Appl. No.: 184,708

[22] Filed: Sep. 8, 1980

[51] Int. Cl.[3] ..... E21B 10/22

[52] U.S. Cl. ..... 175/337; 175/372; 308/8.2

[58] Field of Search ..... 175/331, 337, 371, 372; 308/8, 2

[56] References Cited

U.S. PATENT DOCUMENTS

| | | | |
|---|---|---|---|
| 1,905,079 | 4/1933 | Wellensiek et al. | 308/8.2 |
| 2,025,261 | 12/1935 | Zublin | 175/337 |
| 2,076,000 | 4/1937 | Reed | 308/8.2 |
| 2,147,927 | 2/1939 | Scott | 175/375 |
| 2,194,675 | 3/1940 | Sanders et al. | 308/8.2 |
| 2,297,192 | 9/1942 | Reed | 280/511 |
| 2,673,128 | 3/1954 | Reed | 308/8.2 |
| 2,690,935 | 10/1954 | Alexander | 308/8.2 |
| 2,774,571 | 12/1956 | Morlan . | |
| 2,815,936 | 12/1957 | Peter et al. | 308/8.2 |
| 3,303,898 | 2/1967 | Bercaru | 308/8.2 |
| 3,307,645 | 3/1967 | Hildebrandt | 175/372 |
| 3,990,525 | 11/1976 | Penny | 175/337 |
| 4,098,358 | 7/1978 | Klima | 175/371 |
| 4,102,419 | 7/1978 | Klima | 175/371 |
| 4,194,794 | 3/1980 | Kling | 175/337 X |
| 4,211,453 | 7/1980 | Johansson | 308/8.2 |
| 4,249,622 | 2/1981 | Dysart . | |
| 4,253,710 | 3/1981 | Goodman . | |

FOREIGN PATENT DOCUMENTS

| | | | |
|---|---|---|---|
| 1260080 | 3/1961 | France | 175/372 |
| 266670 | 4/1970 | U.S.S.R. | 175/370 |
| 723089 | 4/1980 | U.S.S.R. | 175/371 |

*Primary Examiner*—Stephen J. Novosad
*Assistant Examiner*—Joseph Falk
*Attorney, Agent, or Firm*—Robert A. Felsman; James E. Bradley

[57] ABSTRACT

An earth boring bit particularly for use in drilling mining blast holes, has features for reducing the possibility of cutter drag and reducing wear on the bit legs. The bit is of the type having three bit legs, a bearing pin depending from each bit leg, and a cutter with a central cavity mounted on each bearing pin with roller bearings. The roller race for the roller bearings is formed in the central cavity of the cutter. The lower side of each bearing pin commences at the outer side of each bit leg, eliminating the shirttail flange. Clearances are provided between the central cavity and the bearing pin at the backface for the discharge of air in a direction parallel with the bearing pin axis.

5 Claims, 3 Drawing Figures

EARTH BORING BIT WITH EXTENDED GAGE

BACKGROUND OF THE INVENTION

This invention relates in general to earth boring bits, and in particular to a mining bit with features that reduce cutter drag and wear on bit legs.

In certain mining operations, blast holes are drilled to a depth of fifty feet or so for receiving explosives. A drill bit having three rotatable cutters or cones is commonly used. The bit is secured to the end of the drill pipe, which is rotated, causing the cutters to rotate and disintegrate the earth formation.

A typical bit has three head sections that are assembled with cutters, then welded together. A bit leg depends from each head section, and a bearing pin depends from each bit leg. A cutter with a central cavity is mounted on the bearing pin, with roller bearings placed between the cutter and the bearing pin. The bit legs and bearing pins contain passages for air to be pumped through from the drill pipe. Some of the air passes between the roller bearings for cooling, and discharges into the borehole for assisting in conveying cuttings into the surface.

The bearing pin is normally an integral component of the bit leg. At the intersection of the bit leg and bearing pin on the lower side, a depending flange, normally called the "shirttail", is formed. On the upper side of the bearing pin and on the inside surface of the shirttail, the intersection of the bearing pin with the bit leg is known as the "last machined surface". The cutter has a backface surrounding the central cavity entrance. A gage surface encircles the backface. When assembled, the backface is closely spaced from the last machined surface. The close spacing is believed to prevent cuttings from entering the bearings. The shirttail also serves to retain the roller bearings in the roller race, which is normally formed in the bearing pin.

One problem with the close spacing between the last machined surface and cutter backface results from the practice of running the bits until destruction. Eventually, thrust wear will push the cutter outward on the bearing pin, causing it to contact the last machined surface. The cutter will drag, damaging the cutting structure and shortening the life of the bit. Another failure point occurs because of the rotation of the bit leg against the borehole wall. This rotation causes wear on the shirttail, which may eventually wear through. The rollers would then fall out, causing the cutters to quickly lock.

SUMMARY OF THE INVENTION

It is accordingly a general object of this invention to provide an improved mining bit.

It is a further object of this invention to provide an improved mining bit with features that reduce cutter drag.

It is a further object of this invention to provide an improved mining bit with features that reduce wear on the bit legs, and reduce the possibility of the roller bearings from falling out.

In accordance with these objects, a bit is provided that has the roller race formed in the cutter instead of in the bearing pin. An outer wall in the roller race retains the roller bearings in the race. The shirttail is completely eliminated, with the lower side of each bearing pin commencing at the outer side of each bit leg. This removes any structure on the head of the bit on the lower side of the bit leg, that might otherwise be contacted by the backface of the cutter and cause drag. On the upper side, substantial clearance is provided between the cutter backface and the bit leg.

The gage surface of the cutter is extended to a greater length than the prior art, with the backface being correspondingly shortened. The gage surface withstands wear better than the prior art shirttails, reducing the possibility of the roller bearings from falling out. Air is pumped through passages in the bit leg and bearing pin and between the roller bearings to exit in an upward direction at the outer surface of the bit leg.

DESCRIPTION OF THE PREFERRED EMBODIMENT

Figure 1:
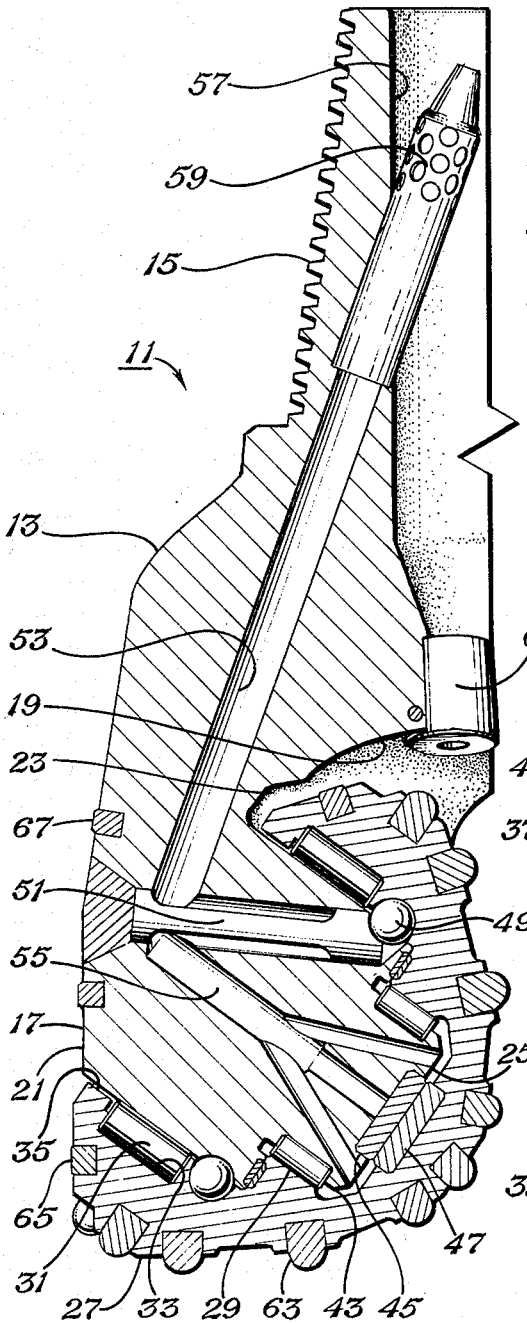
FIG. 1 is a partial sectional view of an earth boring bit constructed in accordance with this invention.

Referring to FIG. 1, an earth boring bit 11 specifically constructed for drilling mining blast holes is shown. Bit 11 has three head sections 13 (only one shown), that are subsequently welded after the bit has been assembled. Threads 15 are formed on the upper end of the bit for securing to a string of drill pipe. Each head section 13 has a bit leg 17 that extends downwardly from a crotch area 19. Each bit leg 17 has an outer surface 21 and an inner surface 23. A bearing pin 25 is integrally formed with each bit leg 17 and depends downwardly at an angle of about 65 degrees with respect to the axis of the bit 11.

A generally conical cutter 27 is rotatably mounted on the bearing pin 25. Two sets of roller bearings 29 and 31 are located between the cutter 27 and the bearing pin 25. The outer set of roller bearings 31 is located in a race 33 formed in a central cavity 35 in the cutter 27. Cutter 27 has a backface 37 (FIG. 3) that encircles the entrance to the central cavity 35 and is in a plane perpendicular to the axis of bearing pin 25. A gage surface 39 encircles the backface 37. Gage surface 39 is frusto-conical and formed at an acute angle with respect to the axis of bearing pin 25.

Figure 2:
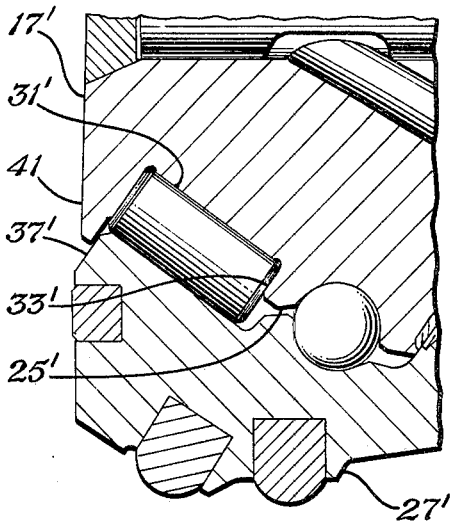
Fig. 2. PRIOR ART
FIG. 2 is an enlarged sectional view of a portion of a prior art earth boring bit.

Referring now to FIG. 2, a typical mining bit has the outer set of roller bearings 31' in a race 33' that is formed in the bearing pin 25', instead of in the cutter 27', as in this invention. Also, the lower end of the bit leg 17' has a depending flange or shirttail 41 that extends in a semi-circle on the extreme lower end. Shirttail 41 serves to retain the roller bearings 33'. The lower side of the bearing pin 25' does not extend to the outer side of bit leg 17', rather commences at the inside of shirttail 41. The backface 37' of the cutter 27' is spaced very closely (about 1/32 inch) from the inside surface of the shirttail 41. At the top (not shown) of the bit leg 17' in the prior art bit, the backface 37' is also spaced the same close distance from the bit leg 17'. The inside surface of the shirttail 41 and the inside of the bit leg 17' at the top are known as the "last machined surface". If the cutter 27' moves outward with respect to the bearing pin 25' more than 1/32 inch, the backface 37' will begin to rub on the last machined surface, causing drag. Also, the outer side of shirttail 41 will wear as it rubs against the borehole wall (not shown). It may eventually wear through to the roller bearings 31', allowing them to fall out.

Figure 3:
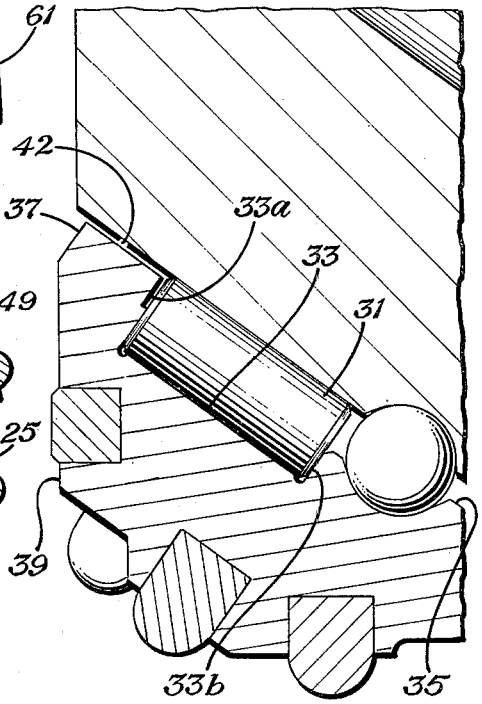
FIG. 3 is an enlarged sectional view of a portion of the bit of FIG. 1.

The differences between the prior art as shown in FIG. 2 and this invention can be best seen by referring to FIG. 3. The roller race 33 is located in central cavity 35 of the cutter 27, not in the bearing pin 25 as in the prior art. An outer wall 33*a* that is annular and perpendicular to the axis of the bearing pin 17 forms the outer side of the roller race 33. An inner wall 33*b*, which is parallel to outer wall 33*a*, forms the inner side of the race 33. The height of the outer wall 33*a* is slightly less than the diameter of the roller bearings 31. A flange is defined on the cutter 27 between the outer wall 33*a* and the backface 37 and gage surface 39. This flange retains the roller bearings 31, preventing them from falling out. The central cavity 35 between outer wall 33*a* and backface 37 is cylindrical concentric with the axis of the bearing pin 25, but of slightly greater diameter than the bearing pin to provide a clearance 42 for the passage of air.

Referring still to FIG. 3, the shirttail 41 of FIG. 2 has been completely eliminated. The lower side or half of the bearing pin 25 extends completely to the outer side of the bit leg 17. This defines a semi-circular corner that is free of any obstructions to the discharge of air from clearance 42 on the lower side of the bearing pin 25. Referring to FIG. 1, the upper half or side of the bearing pin 25 commences at the bit leg inner side 23.

The length of bearing pin 25 is selected so that a substantial clearance of about ¼ inch is provided between the cutter backface 37 and the bit leg inner side 23. There is no structure on the head section 13 or bit leg 17 any closer to the cutter backface 37 than ¼ inch. The cutter 27 has been dimensioned so that in a fifteen inch bit, the diameter of bit 11 at the gage surface 39 is about one half inch greater than the diameter of the bit at the bit leg 17.

More precisely describing the other features in the preferred embodiment, the bearing pin 25 includes a nose portion 43 that is cylindrical but of smaller diameter than the larger cylindrical portion that joins the bit leg 17. The inner set of roller bearings 29 are located in a race formed in the nose portion 43. A nose button 45 is located on the inner end of the nose portion 43 for engaging a mating nose button 47 in the bottom of the cavity 35 in the cutter 27. A plurality of balls 49 are located in mating races formed in the bearing pin 25 and cutter 27 for serving as retaining means for retaining the cutter 27 on the bearing pin. A ball plug 51 is inserted into a passage in the bearing pin 25 to retain the balls 49.

A clearance exists between the inner end of nose portion 43 and the bottom of cavity 35. This clearance is slightly less than the ¼ inch clearance between cutter backface 37 and bit leg inner side 23. If the nose buttons 45 and 47 wear completely, the bearing pin nose portion 43 will rub against the cutter cavity 35 before the cutter backface 37 would contact the bit leg inner side 23. The bearing pin 25 is a single cylinder from the balls 49 race to the bit leg 17, having no grooves or flanges formed in its surface.

Air passages 53 and 55 are formed in the head section 13 and bearing pin 25 respectively, for receiving drilling fluid such as air being pumped down an axial passage 57 in the drill bit 11. A filter 59 is located at the entrance of each air passage 53. A nozzle 61 formed in each head section 13 discharges a portion of the air into the borehole, with the remainder being pumped down the passages 53 and 55. The exterior surface of the cutter contains a plurality of tungsten carbide inserts 63 for disintegrating the formation. Wear resistant tungsten carbide buttons 65 and 67 are located in the gage surface 39 and in the outer side of the bit leg 17.

In assembly the head sections 13 are each assembled with a cutter 27. During assembling, the roller bearings 29 are placed in the race on the nose portion 43 and retained by heavy grease. The outer roller bearings 31 are placed in the race 33 in the cutter 27 and retained by grease. Then the cutter 27 is pushed over the bearing pin 25. Balls 49 are then dropped through the ball passage, and retained by ball plug 51, which is subsequently welded in place. The three head sections 13 and then welded together and threads 15 formed.

In operation, the bit is secured to the drill string by threads 15 and lowered into the borehole. The drill string is rotated, causing each cutter 27 to rotate about the axis of each bearing pin 25. Gage surface 39 will engage the borehole wall in rolling contact as the bit rotates. As the nose buttons 45 and 47 wear, the cutters 27 will move outwardly on the bearing pin 25. The cutters 27 would have to move outward a very large distance, approximately one fourth inch, before the backface 37 would begin to drag against the bit leg 17. There is no structure on the lower side of the bit leg 17 to be connected by the backface 37. The only structure that could be contacted would be on the inner side 23 of the bit leg 17, and this is located a substantial distance from the backface 37. Preferably, the distance is sufficient so that the cutting teeth 63 will be completely worn prior to any cutter drag occurring.

During drilling, a drilling fluid such as air is pumped down the drill pipe, down the axial passage 57 and out nozzles 61 for removing cuttings from the borehole. Some of the air is also diverted through the filters 59, and down passages 53 and 55. The air flows between the roller bearings 29, balls 49 and roller bearings 31. The air passes out each clearance 42 in a direction parallel with the axis of the bearing pin 25. On the lower side of the bearing pin 25, the air being discharged will be in an upward direction, flowing up past the bit leg 17.

The invention has significant advantages. Removing the shirttail and providing a large clearance between the bit leg and cutter backface above the bearing pin reduces the chances for cutter drag. Also, removing the shirttail allows an appreciably larger diameter at the gage surfaces than at the bit legs. The gage surface, with its rolling contact against the borehole wall, is more resistant to wear than the bit leg. This should reduce the possibility for wear occurring completely into the roller race, allowing the rollers to fall out.

While the invention has been shown in only one of its forms, it should be apparent to those skilled in the art that it is not so limited but is susceptible to various changes and modifications without departing from the spirit thereof.

I claim:

1. In an earth boring bit of the type having three bit legs, a bearing pin depending from each bit leg, and a cutter having a central cavity and mounted on each bearing pin with roller bearings, each of the roller bearings having inner and outer ends, the improvement comprising in combination:

a roller race formed in the central cavity for receiving the roller bearings, with an annular outer wall to retain the roller bearings in the race;

the lower side of each bearing pin commencing at the outer side of each bit leg, defining a corner free of a shirttail flange; the bearing pin from the inner ends of the roller bearings to the bit leg being cylindrical and of constant diameter.

2. An earth boring bit of the type having three bit legs, a bearing pin depending from each bit leg, and a cutter mounted on each bearing pin by roller bearings with a central cavity that has an entrance encircled by a backface and a gage surface, each of the roller bearings having inner and outer ends, the improvement comprising in combination:

a roller race formed in the central cavity for receiving the roller bearings, defining a flange between the roller race and the gage surface and backface for retaining the roller bearings in the roller race;

the bearing pin having a cylindrical portion of constant diameter that extends from the inner ends of the roller bearings to the bit leg, with the lower side of the cylindrical portion extending to the outer side of the bit leg, freeing the bit leg of any structure on its lower end that is located outside of the gage surface and backface.

3. In an earth boring bit of the type having three bit legs, a bearing pin depending from each bit leg, a cutter having a central cavity and mounted on each bearing pin with roller bearings, the entrance to the central cavity being encircled by a backface, which is encircled by a gage surface, each of the roller bearings having inner and outer ends, the improvement comprising in combination:

a roller race formed in the central cavity of each cutter for receiving the roller bearings, with an annular outer wall perpendicular to the axis of the bearing pin for retaining the roller bearings; the height of the outer wall being slightly less than the diameter of the roller bearings at the outer ends;

the bearing pin having a cylindrical portion of constant diameter that extends from the inner ends of the roller bearings to the bit leg, with the lower side of the cylindrical portion extending to the outer side of the bit leg, the cavity between the outer wall of the roller race and the backface being larger in diameter than the cylindrical portion of the bearing pin, defining an annular clearance for discharging drilling fluid.

4. In an earth boring bit of the type having three bit legs, a bearing pin depending from each bit leg, a cutter having a central cavity and mounted on each bearing pin with roller bearings, the entrance to the central cavity being encircled by backface which is encircled by gage surface, the bit further having retaining means for retaining the cutter on the bearing pin and drilling fluid passage means extending through the bit legs and bearing pins for pumping drilling fluid between the roller bearings, the improvement comprising in combination:

a roller race formed in the central cavity of each cutter outward from the retaining means for receiving the roller bearings, defining a flange between the roller race and the gage surface and backface for retaining the roller bearings in the roller race;

each bearing pin from the retaining means to the bit leg being a single cylindrical surface, with the lower side of each bearing pin extending to the outer side of each bit leg, freeing the bit leg of any structure on its lower end that is located outside of the gage surface and backface;

clearances being provided between each central cavity and each bearing pin at the flange for discharging drilling fluid pumped between the roller bearings.

5. In an earth boring bit of the type having three bit legs, a bearing pin depending from each bit leg, a cutter having a central cavity and mounted on each bearing pin with roller bearings, the entrance to the central cavity being encircled by an annular backface perpendicular to the axis of the bearing pin, which is encircled by a frusto-conical gage surface formed for rolling contact with the borehole wall, the bit further having drilling fluid passage means extending through each bit leg and bearing pin for pumping drilling fluid between the roller bearings for cooling, the improvement comprising in combination:

a roller race formed in the central cavity of each cutter for receiving the roller bearings, with an annular outer wall perpendicular to the axis of the bearing pin for retaining the roller bearings;

the central cavity between the outer wall and the backface of each cutter being cylindrical and of larger diameter than the bearing pin at the same point, for providing a clearance to discharge drilling fluid through the passage means into the borehole;

the lower side of each bearing pin extending completely to the outer side of each bit leg, defining a corner on the lower end of each bit leg that is free of any obstructions to the flow of drilling fluid being discharged through the clearance parallel with the axis of the bearing pin.

* * * * *